US006004053A

United States Patent [19]

Petteruti et al.

[11] Patent Number: 6,004,053

[45] Date of Patent: Dec. 21, 1999

[54] PRINTER APPARATUS

[75] Inventors: Steven F. Petteruti, East Greenwich; Richard J. Preliasco, North Kingston, both of R.I.

[73] Assignee: Comtec Informationsystems, Inc., Warwick, R.I.

[21] Appl. No.: 09/151,591

[22] Filed: Sep. 11, 1998

[51] Int. Cl.[6] ..... B41J 3/36

[52] U.S. Cl. ..... 400/693; 400/88

[58] Field of Search ..... 400/693, 88; 101/288

[56] References Cited

U.S. PATENT DOCUMENTS

| | | | |
|---|---|---|---|
| D. 372,730 | 8/1996 | Saskaki | D18/4 |
| 3,389,402 | 6/1968 | Rosmanith | 346/76.1 |
| 3,651,310 | 3/1972 | Link | 235/380 |
| 3,728,522 | 4/1973 | Norwich | 235/380 |
| 3,749,887 | 7/1973 | Giuliani | 235/380 |
| 4,199,100 | 4/1980 | Wostl et al. | 235/381 |
| 4,297,039 | 10/1981 | Lees | 400/120 |
| 4,707,592 | 11/1987 | Ware | 235/379 |
| 4,772,146 | 9/1988 | Saito et al. | 400/649 |
| 4,848,941 | 7/1989 | Imaseki | 400/120 |
| 4,896,166 | 1/1990 | Barker et al. | 400/120 |
| 4,927,278 | 5/1990 | Kuzuya et al. | 400/208 |
| 5,096,314 | 3/1992 | Komori et al. | 400/175 |
| 5,208,446 | 5/1993 | Martinez | 235/380 |
| 5,278,752 | 1/1994 | Narita et al. | 235/380 |
| 5,294,782 | 3/1994 | Kumar | 235/462 |
| 5,334,821 | 8/1994 | Campo et al. | 235/380 |
| 5,334,824 | 8/1994 | Martinez | 235/375 |
| 5,386,106 | 1/1995 | Kumar | 235/462 |
| 5,481,290 | 1/1996 | Watanabe et al. | 400/652 |
| 5,489,773 | 2/1996 | Kumar | 235/462 |
| 5,579,043 | 11/1996 | Patry | 347/222 |
| 5,661,634 | 8/1997 | Obata et al. | 361/684 |
| 5,679,943 | 10/1997 | Schultz et al. | 235/381 |
| 5,779,371 | 7/1998 | Aoyama et al. | 400/120.16 |
| 5,876,129 | 3/1999 | Suzuki | 400/120.01 |

FOREIGN PATENT DOCUMENTS

| | | |
|---|---|---|
| 8-112951 | 5/1996 | Japan . |

*Primary Examiner*—Ren Yan
*Assistant Examiner*—Daniel J. Colilla
*Attorney, Agent, or Firm*—M. Lukacher; K. Lukacher

[57] ABSTRACT

A miniature printer is provided with a printer mechanism in a housing. A thermal printhead is fixedly mounted in the mechanism. The mechanism and the housing define a compartment for a roll of paper which is loosely disposed in the housing and is extended over the thermal printhead. The compartment is closed by a cover hinged to the housing at one end thereof. A platen roller is located in the cover in an opening larger than the shaft of the roller, which opening and cover provides a floating mount for the platen roller. A driven gear which rotates the platen roller is mounted on the shaft near one end thereof. A pair of hairpin springs have ends which are located in the path which the platen roller takes as the cover is closed and moves into engagement with the platen roller. These springs are deflected backwardly away from the printhead as the platen roller passes over the springs and then toward the printhead so as to reseat a portion of the springs to the platen roller shaft, and specifically to bushings on opposite sides of the platen roller on the shaft. The springs align the platen roller with the printing elements on the printhead and bias the platen roller into engagement with the printhead, while latching the platen roller and the cover in closed position. The driven gear on the shaft also is aligned with the last gear of a train of gears from a motor to drive the platen. The housing mounts the electronics of the printer, which are on a printed circuit board, and also a magnetic card reader. Another cover extends from the cover carrying the platen roller and covers the housing while exposing an opening in the magnetic card reader across which a magnetic card may be swiped for reading the data on the magnetic track of the card.

20 Claims, 5 Drawing Sheets

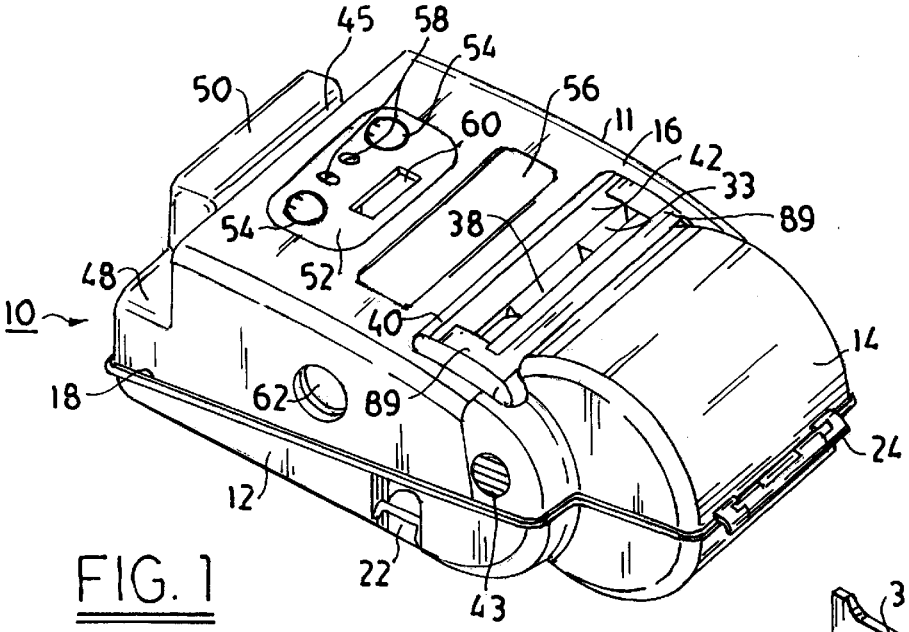
FIG. 1
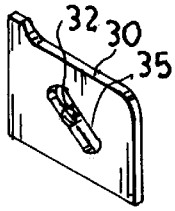
FIG. 2B
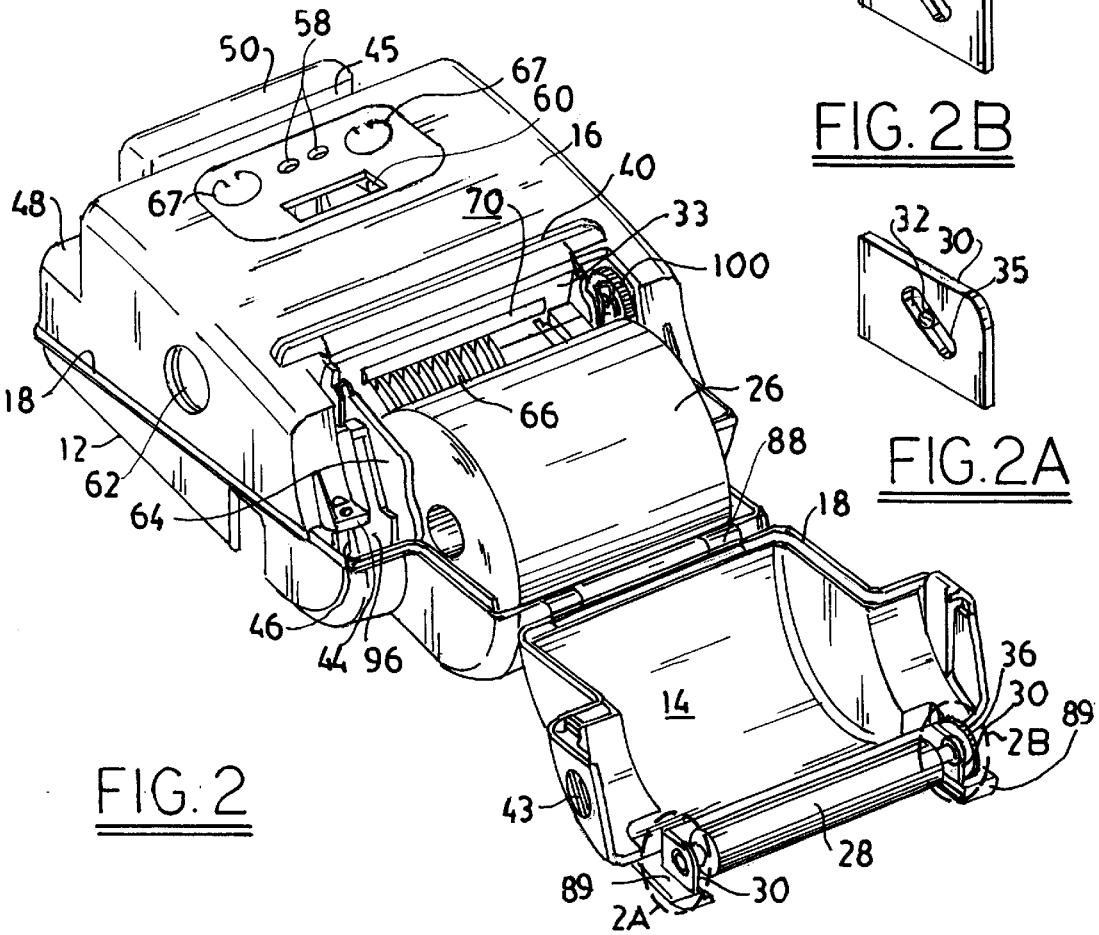
FIG. 2
FIG. 2A

PRINTER APPARATUS

DESCRIPTION

The present invention relates to printer apparatus and more particularly to a miniaturized printer contained in a housing with a magnetic card reader so as to provide an integrated printer, card reader unit.

The invention provides an improved printer mechanism wherein a thermal printhead is fixedly mounted and a platen is carried on a floating mount, which may be provided in a cover extending at least partially over the printer mechanism and enclosing a compartment containing a roll of paper which extends over the printhead and is maintained in driving relationship with the platen roller in contact with the print elements of the head when the cover is moved to a closed position. Springs are mounted in the printing mechanism and allowed to flex. These springs are interactive with the platen roller so as to permit the platen roller to move into engagement with the printhead and, when in engagement, to bias and latch the platen roller against the printhead while aligning the platen roller with the printhead. In addition, a gear on the platen roller engages gears in a gear train driven by a motor and aligns itself with these gears to transfer power to the platen roller for driving the paper during printing operations. The printing mechanism may be miniaturized for portable operation when carried by a user who can enter information via the magnetic card for printing, together with other information which may be entered from a terminal connected to the printer or from a remote host computer via wire line, infrared or radio link.

Printer mechanisms are combined with card readers in units other than those designed for use on a desktop or counter, that is for personal use by the operator. Personal printer/card readers, or printer mechanisms used with other input/output devices when adapted for personal use, sacrifice printing quality or low cost in order to adapt them for use in devices integrated with card readers or other input/output devices. For example, such devices are characterized by moveable and especially pivotal printhead mounts which are carried in the housing of the printer in order to allow the printhead to move into alignment with a platen roller, when that roller presses the paper or other stock on which printing is to be carried out by the printhead against the printhead. In some cases, the printhead is moveably mounted while the platen roller is journaled in fixed bearings in the housing of the device. Another approach is to mount the platen roller in a cover which closes the housing, and the printhead, which is usually flexurally mounted, as on pivots, is in the main housing of the device, or the platen may be flexurally mounted, further complicating the design of the printing mechanism.

It is a feature of the invention to provide an improved printer which is combined in the same unit with a magnetic card reader or other I/O device in a unitary structure adapted for personal use.

It is a still further object of the present invention to provide an improved printer mechanism wherein a fixed printhead may be used together with a platen, which is mounted to float in a cover which closes a housing, including the printing mechanism, leaving an opening for paper or other stock, to pass the printhead and to be disposed in printing relationship therewith and in driving relationship with a platen roller, wherein the roller and the cover in which it may be mounted, are engaged, latched and biased against the printhead by flexural elements, namely springs which may be hairpin or wire springs and which are mounted to flex when engaged when the platen roller is moved into printing relationship with the printhead.

It is a still further object of the present invention to provide an improved printing mechanism which defines, in part, a compartment for a roll of paper which may be loosely disposed in the compartment, which compartment may be varied in width, in order to contain rolls of different length, such that the weight of the roll tensions the paper as it is driven by the platen roller while maintaining the printing relationship of the paper with the printhead.

It is a still further object of the present invention to provide an improved printer unit which may be combined with a card reader or other device for entering data to be printed having a housing with covers which can be readily opened for maintenance, repair and replacement of supplies and parts which need to be replaced, such as a thermal printhead and paper rolls.

It is a still further object of the present invention to provide an improved printer mechanism in which the printhead is fixedly mounted in snap-in relationship in the frame of the printing mechanism, as by ears which extend laterally from the printhead into notches in side plates which flex upon insertion of the ears into the notches, to latch the printhead removably in place in the mechanism.

The foregoing and other objects, features and advantages of the invention as well as a presently preferred embodiment thereof will become more apparent from a reading of the it following description in connection with the accompanying drawings, brief descriptions of which are as follows.

FIG. 1 is a perspective view of a miniaturized printer and card reader embodying the invention;

FIG. 2 is a perspective view of the printer/card reader shown in FIG. 1 with a cover which captures a roll of paper on which printing is carried out, the cover being in open position;

Figure 3:
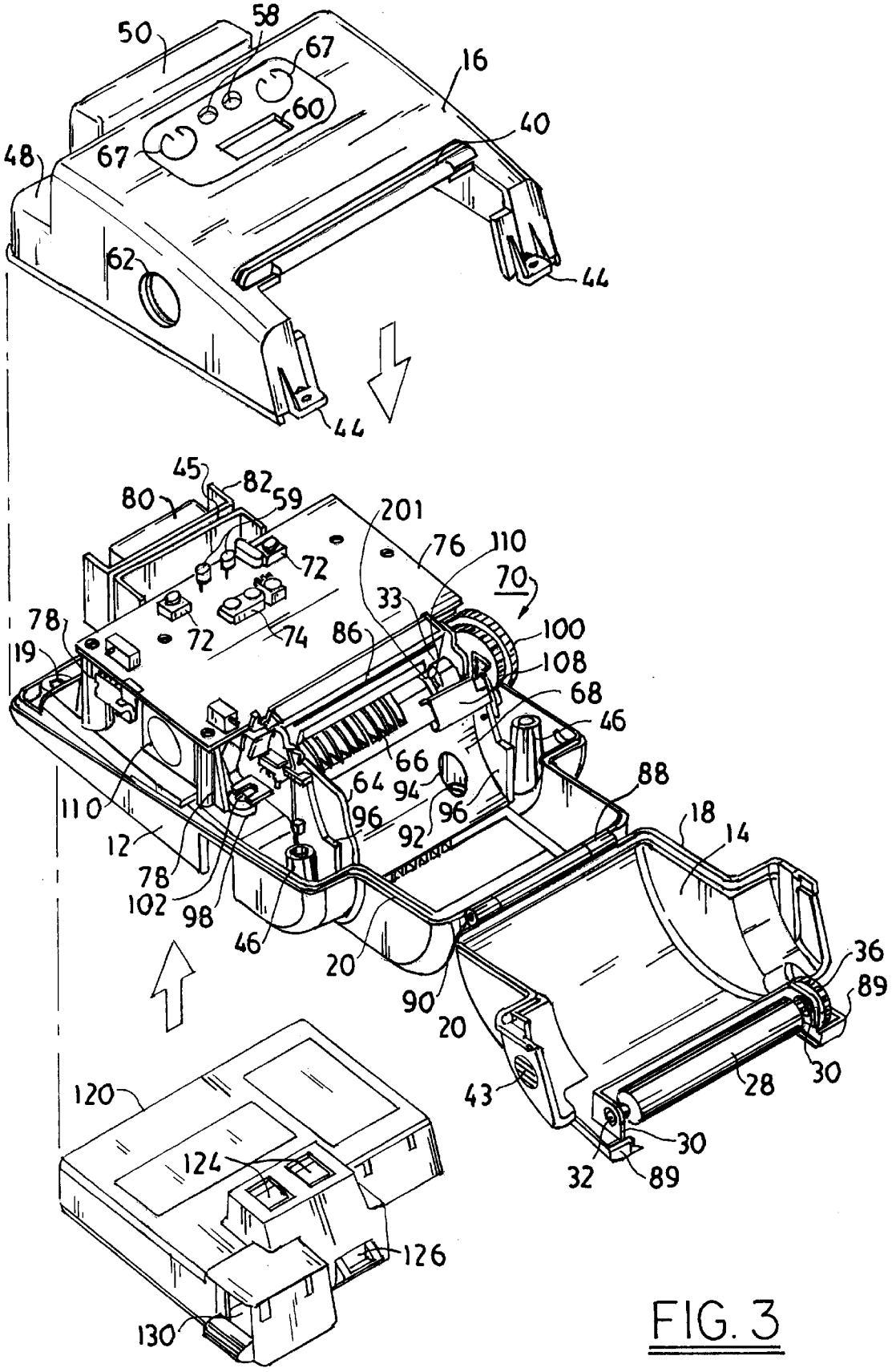
Figure 5:
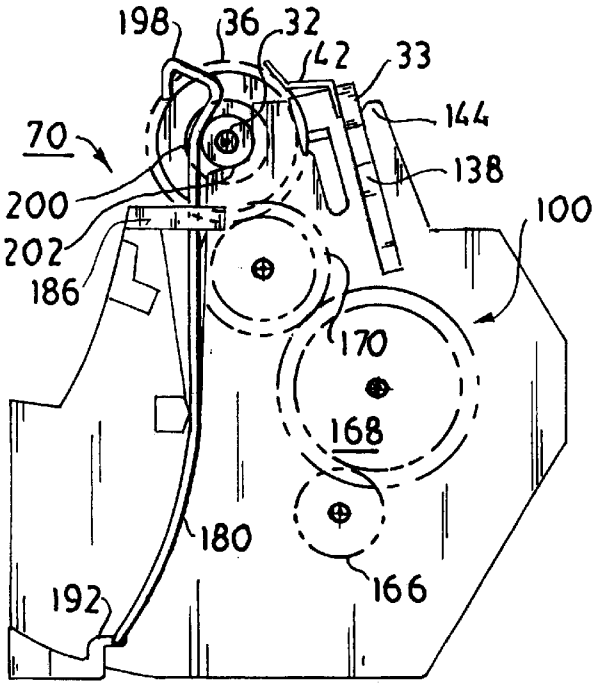
Figure 4:
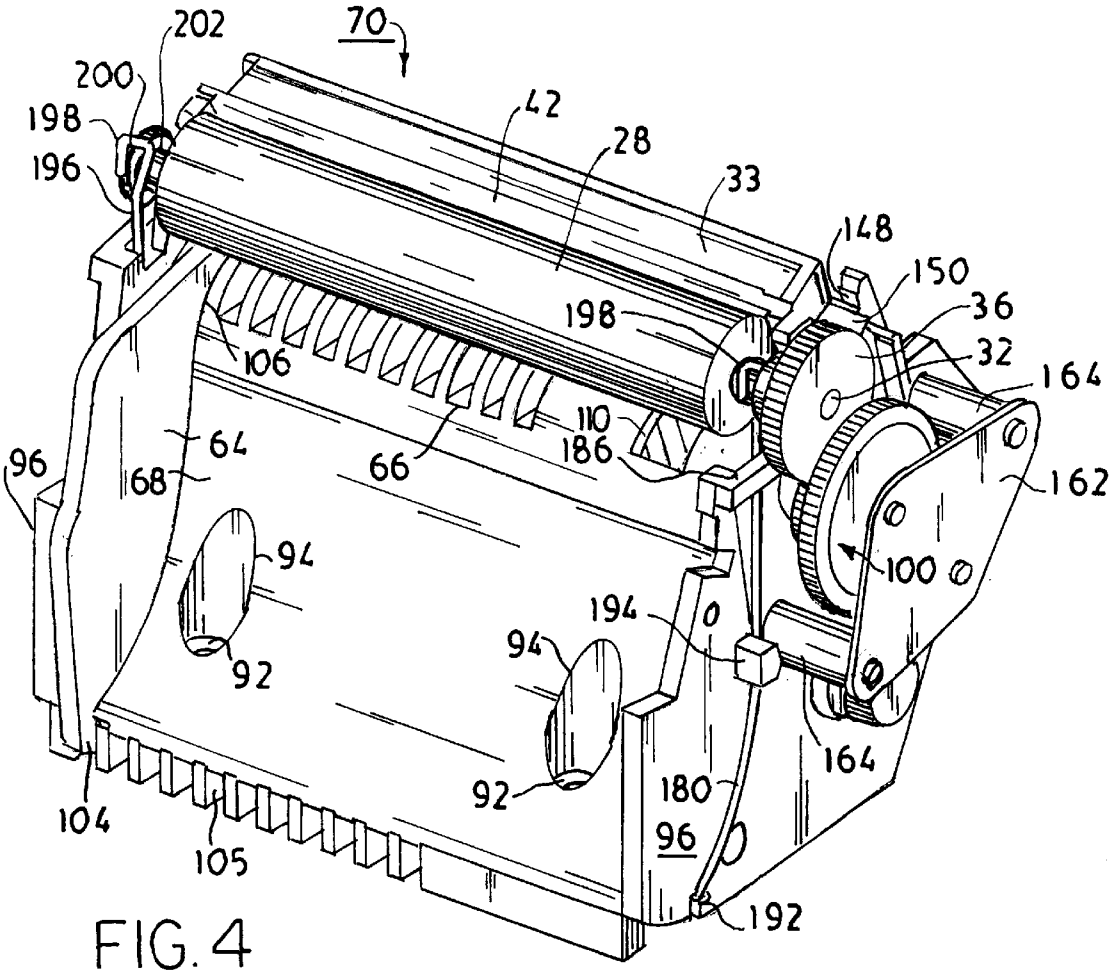
Figure 6:
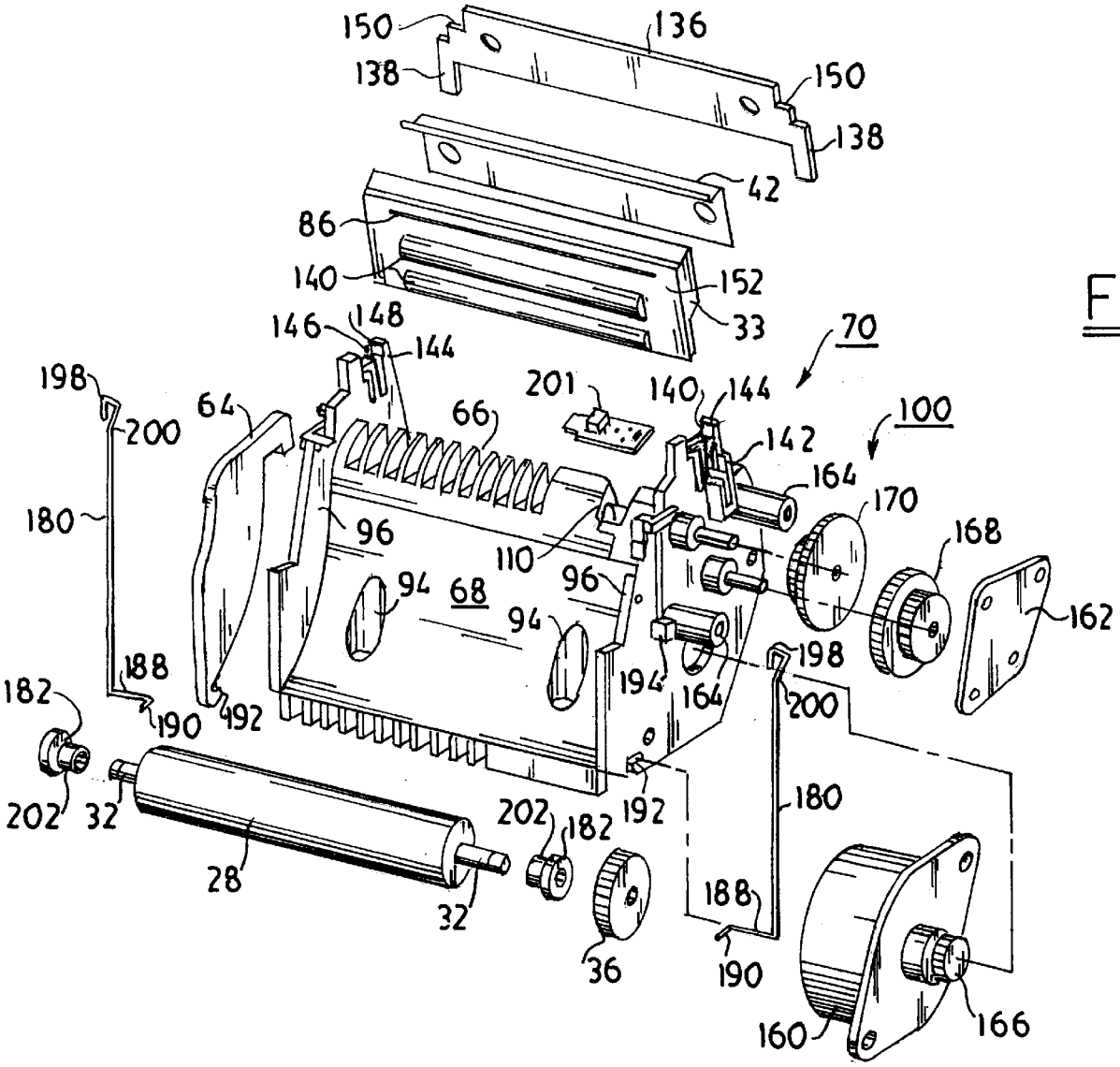
Figure 7:
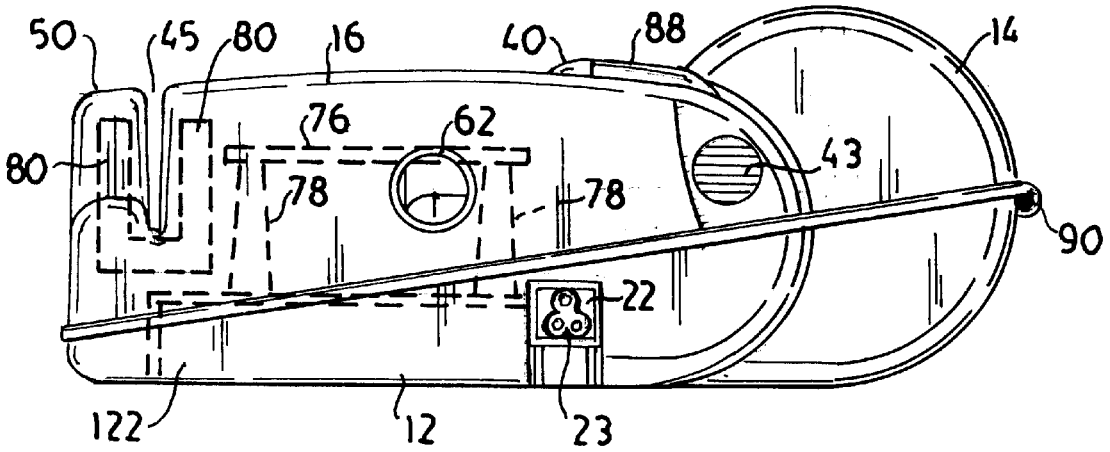
Figure 8:
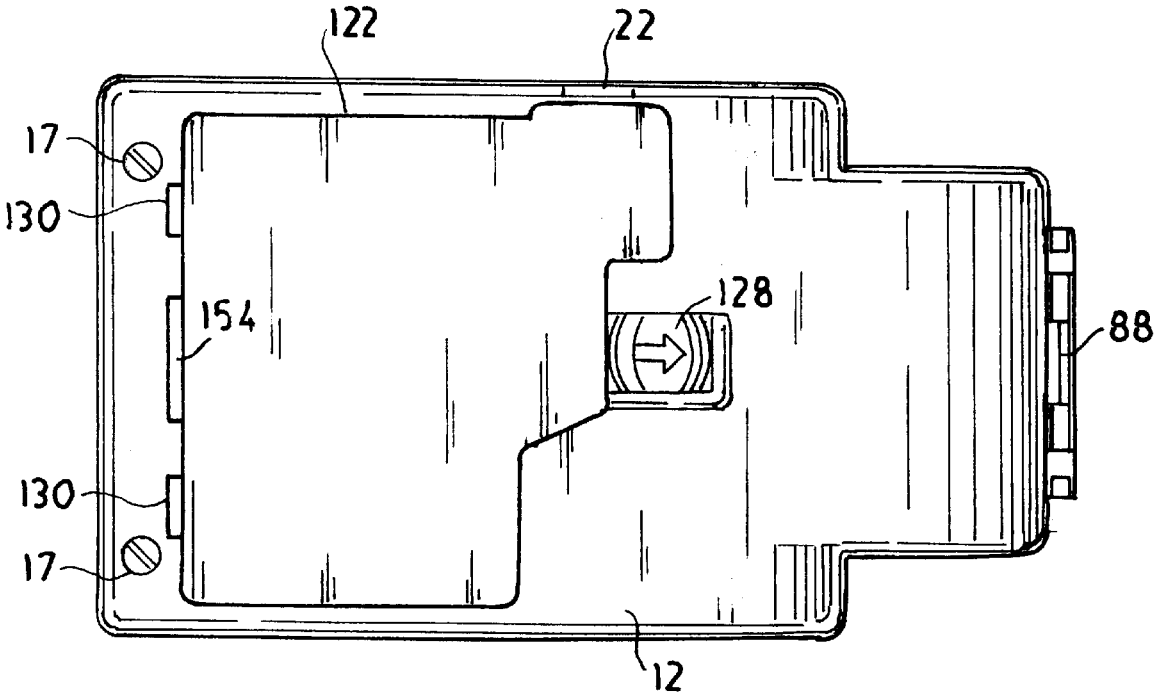

FIGS. 2A and B are side view in the areas within the dash lines 2A and 2B which show the brackets journaling the shaft of the platen roller;

FIG. 3 is a perspective, exploded view of the printer/card reader with the cover which captures the roll of paper in open position as in FIG. 2 and exposing the card reader and printed circuit board mounting the electronics associated with the printer and card reader and also showing a battery which is insertable into the housing in a battery compartment on the underside of the housing;

FIG. 4 is a perspective view of the printer mechanism which is contained in the housing and is shown in FIGS. 2 and 3;

FIG. 5 is a side elevational view of the printer mechanism shown in FIG. 4 with the guard over the gear tram removed to illustrate the gear train which couples the drive motor to the gear which drives the platen;

FIG. 6 is an exploded view of the printer mechanism shown in FIGS. 4 and 5;

FIG. 7 is a side view of the printer/card reader which illustrates schematically the location of the battery compartment, the printer circuit board and the card reader in dash lines; and FIG. 8 is a bottom view of the printer/card reader illustrating the battery compartment when closed by cover.

Referring to FIG. 1, the miniature printer/card reader 10 shown therein may be approximately seven inches long, three and one-half inches wide and three inches high and weigh less than two pounds. A case 11 encloses the device and includes a lower housing section 12 and two upper housing sections 14 and 16 which provide covers to close the lower housing section 12 along edges 18, which overlap an indented edge 20 of the lower housing section, which mates therewith. The lower housing section has an opening 22 which exposes a connector 23 (FIG. 7) for a battery charger which charges a battery located in a compartment 122 (FIGS. 7 and 8) on the underside of the lower housing section. The upper housing section 14 is hinged at 24 by means of a hinge 88 to an end of the lower housing section 12, and forms a compartment which encloses a roll of paper 26 (FIG. 2). This is a spindleless roll and may be thermally sensitive paper or paper having thermally sensitive labels thereon. The cover carries a platen roller 28, the shaft 32 of which is journaled in brackets 30 having holes 35 larger than the ends of the platen roller shaft 32 which project therethrough. These holes are oval shaped and permit the platen roller to float and direct the movement of the roller 28 into alignment with a thermal printhead 33 when the cover 14 is closed. The holes 35 with the shaft projections therethrough, are illustrated in FIGS. 2A and 2B. A gear 36 is carried on the platen roller shaft 32 outside one of the brackets 30 and is the final gear of a gear train which rotates the platen roller 28 so as to drive the paper from the roll 26 through an opening 38 formed between the cover 16 and the cover 14, when the cover 14 closes to the position shown in FIG. 1. This opening is defined in part by fingers 89 which extend from the hinged cover 14. The hinge 88 and its pin 90 are shown in FIGS. 3, 7 and 8.

The fixed cover 16 has a ridge or feature 40 which forms a lip guarding a tear bar or strip 42 which projects into the opening 38. The cover 14 has finger holes 43 on opposite sides thereof which may be engaged by the operator to open and close the cover.

The fixed cover section 16 may be attached by screws 17 (FIG. 8) to the lower housing section. These screws extend through bosses 19 (FIG. 3) into threaded holes in other bosses (not shown) in the fixed cover 16. Brackets 44 for screws, which extend into posts 46 projecting from the lower housing section, may be used for attachment of the cover 16 to the lower housing section 12. Alternatively, the cover 16 may be hinged or otherwise flexurally connected along the rear edge thereof to the lower housing section 12.

The cover 16 has a step 48 along its rear edge which provides a base for guidance of a magnetic card through a slot 45 in a block 50 which provides a guide post for the card. A magnetic track reader provided by a card reader assembly 80 (FIG. 3) is housed in part under the block 50 for reading data from the track when the card is swiped through the slot 45.

The top of the cover has a flexible skin 52 which is attached thereto. The skin is marked with circles 54 defining an on/off button and a feed button to control feeding of the paper through the opening 38. Another area 56 is provided for a label identifying the printer/card reader by its trademark. The skin 52 also has areas over holes 58 for lamps (such as LEDs 59 (FIG. 3) which indicate the operating condition of the device. There is an area over an opening 60 which exposes an infrared transducer for providing communications between the printer/card reader 10 and another device, such as a key board or terminal carried by the user. Communications with the device may be through a connector which is exposed in a hole 62 in the side of the cover 16. Communications with the printer/card reader 10 may also be via a radio link to a transceiver which is housed in the unit on the lower housing 12 under a printed circuit board 76 (FIG. 3).

The housing section 12 and the covers 14 and 16 may be molded from plastic material.

As shown in FIG. 2, there is a side plate 64 which is insertable in any one of a series of slots 66 in a curved side 68 in the body, with side plates 96, of a printer mechanism 70 containing the printhead 33. Tabs on the sides of the slots 66 flex to hold the plate 64 in the selected slot. The slot which is used depends upon the width of the roll 26, and the plate 64 and slots 66 enable rolls of different width to be used in the printer/card reader 10. The plate serves as an edge or end guide for the paper roll 26.

When the skin 52 is removed, the opening 60 which exposes the IR transducer and holes 58 which expose the LEDs are visible, as shown in FIG. 2. Arcuate slots 67 are also exposed which permit the housing 16 to flex in the area of the buttons 54 so as to operate switches 72. The switches 72, the LEDs 59 and the IR transducer 74 are mounted on the printed circuit board 76 which is attached to the lower housing by screws into standoff posts 78 projecting from the lower housing, as shown in FIG. 3. The electronics for operating the printer and receiving control signals via the IR transducer or a cable, which is connected to the connector 110, exposed by the hole 62, and also data which is read by the card reader may be of the type described in Petteruti U.S. Pat. No. 5,267,800 issued Dec. 7, 1993 or in allowed U.S. patent application Ser. No. 08/819,746 filed Mar. 18, 1997, now U.S. Pat. No. 5,806,993, issued Sep. 15, 1998.

Referring again to FIGS. 1 and 2 of the drawing and also to FIGS. 3, 7 and 8, the card reader assembly 80 includes the magnetic heads for reading magnetic stripes or tracks on cards which are swiped through a guideway structure 82, which is exposed via openings along sides of the slot 45. This assembly 80 is mounted by flanges (not shown) thereon to mounting sites on the bottom housing 12. The assembly 80 may be of the type which is commercially available and provides, by way of a cable (not shown), inputs to the electronics which is mounted on the card 76. The electronics reads the data on the magnetic stripes and translates it into printed characters by energizing appropriate elements of the line of elements 86 on the printhead 34 in appropriate sequence as the paper is driven by the platen past the printhead and out the opening 38 in the cover 16 (FIG. 1).

The printing mechanism 70 body is a moldment of plastic which defines the face 68 of the compartment which receives the paper roll 26. The mechanism is attached to the housing section 12 by hold down screws 92 which are accessed via openings 94. The drive motor and gear train 100, two of the gears of which are visible in FIGS. 2 and 3, is mounted outside of one of the side plates 96. The other side plate has a tab 98 with a notch into which an alignment pin 102 from the lower housing section 12 extends to assist in locating the printer mechanism 70 in the lower housing section 12.

The width adjusting (paper roll edge guide) plate 64 has a tongue 104 (see FIG. 4) at the lower tip thereof which extends into notches 105 in the moldment along the lower edge of the surface 68. These grooves 105 are in alignment with the slots 66 which receive tongues 106 at the upper end of the plate 64. These tongues snap into the selected one of the grooves 68 to adjust the width of the roll receiving compartment in the lower end of the housing section 12. The printer/card reader 10 is preferably disposed with the lower end vertically downward so that the weight of the roll provides back tension force on the paper as it is driven between the printhead 33 and the platen 28. The possibility that any loops of paper might be formed which could cause jams is reduced because of the back tension provided by the weight of the roll, which prevents the formation of such loops.

The paper extends over a guide segment 108 which shields an optical detector 201. A slot 110 provides a aperture for light from the optical detector 201 (an opto or optical transmitter receiver) which detects paper in the bight between the printhead and the platen roller 28. FIG. 6 shows the opto sensor 201 which is mounted in the printing mechanism so that the light source and photodetector thereon are visible through the slot 110.

The printed circuit board 76 may have mounted on the underside thereof a short range radio transceiver (SRRF) for communicating by radio with a central terminal including a central or host computer. The host computer or central terminal may be connected via a cable in a connector 110 mounted on the underside of the board 76 and exposed through the opening 62 in the upper cover 16. This connector may also be at the end of a cable which connects the printer/card reader 10 to an auxiliary terminal, for example with a display and keyboard for entering data for printing. The SRRF may alternatively be in the auxiliary terminal.

A battery unit 120 is insertable into a compartment 122 (FIGS. 3, 7 and 8) which is accessed by an opening in the bottom side of the lower housing section 12. The battery unit 120 has contacts 124 which engage contacts on a contactor depending from the board 76. Contact is maintained by a latch mechanism including a catch 126 and a finger operated latch 128 which snaps into the catch 126 when the battery is placed in the compartment 122. The battery compartment 122 has tabs (not shown) which are caught in notches 130 longer than the tabs. The battery case 120 is then pivoted downwardly into the compartment until the contacts 124 engage the contact strips depending from the board 76 and the latch 128 holds the battery in place. The battery unit 120 has a built in charger or a connector 23 which is exposed through the side opening 22 of the lower housing section 12 for receiving a cable or a connector from a battery charger or from a source of power for charging the batteries in the unit 120.

The printing mechanism 70 is shown in greater detail in FIGS. 4, 5, and 6. It will be observed that the printhead 33 is part of an assembly with the tear bar 42 and a back plate 136 having ears 138. The printhead 33 has a line of printing elements 86 and rounded projections 140 which contain circuitry connected to the printing elements in the line of elements 86. The printhead is mounted in the side plates 96 by locating the ears 138 into receptacles 142 which are adjacent to fingers 144 (flexible portions of the side plates which are yieldable), which are defined on one side of slots (notches) and provide faces thereof. The ears 138 partially extend into the receptacles 142. Tabs 148 on the faces of the slots 146 are deflected backwardly when the back plate 136 and the ears 138 are inserted into the slots (notches). The tabs engage upper edges 150 of the backplate 136 and latch the printhead assembly in place.

The slots (notches) 148 are disposed at a small angle, say about 15 degrees to the vertical (best shown in FIG. 5). The front surface 152 of the printhead 33, at which the line of printing elements 86 is located, is inclined at the same angle (about 15 degrees to the vertical). When the paper leaves the slot 38 formed between the upper covers 14 and 16 and the printer/terminal is disposed with the roll receiving compartment downward, the side of the paper on which the printing appears is tilted toward the head of the user. This facilitates the use of the printer/card reader 10.

In order to carry printer and card reader 10 with the roll compartment end downward, a hook, which attaches to the belt of the user, may be inserted in an opening 154 on the bottom side of the housing section 12. This opening is visible in FIG. 8.

The platen drive is provided by a motor 160 mounted on the side plate 96, which also mounts the gear train. The motor 160 may be a stepping motor which is operated by the electronics for printing successive rows of dots with the printhead. This forms characters or symbols which are printed. The drive signals to the motor are obtained from the electronics carried by the printed circuit board 76, which, as noted above, may be of the type discussed in the above-reference Petteruti Patents. The gear train is covered by a guard plate 162 mounted to the side plate on standoffs 164. The drive gear 166 has its speed reduced by a set of double spur gears 168 and 170. The driven gear on the platen roller shaft 36 engages the smaller gear of the double spur gear 170 and is automatically aligned and held in engagement by a latching and biasing system utilizing a pair of wire or hairpin springs 180.

The platen roller shaft 32 extends beyond the ends of the platen roller and receives flanged bushings 182. These bushings limit axial movement of the platen roller 28 and its shaft by occupying the space between the ends of the platen roller and the insides of the brackets 30, which are mounted on the fingers 89 extending from the cover (see FIGS. 1 and 2). The shaft ends project into the opening 35 on the bracket 30 at the left end of the cover as viewed in FIG. 2 (see FIG. 2A). The shaft end extends through the opening 35 and the right side bracket 30, as shown in FIG. 2B, and past that bracket to provide an end on which the driven gear 36 is mounted. There may be a taper or force fit which connects the shaft 32 and the gear 36 so that when the gear is driven the platen roller will rotate and drive the paper through the printing mechanism.

The wire springs 180 are preloaded by virtue of their mounting on the side plates. The springs have ends 188 with right angle tabs 190 that are received in notches 192 in the side plates. The springs are bent over bosses 194 and extend under protective fingers 186 projecting from the sides of the side plates 96. The springs are therefore retained against the outer walls of the sides plates 96. The upper ends of the springs have hook portions 198 and portions 200 extending from the hook portions 198.

In operation, the cover 14 is rotated about its hinge 88 and the small diameter parts 202 of the bushings engage the hook portions 198 and deflect them rearwardly so that the small diameter parts 202 of bushings 182 bypass and snap over the hook portions 198. As the cover continues to rotate the portion 200 underlying the hook portion 198 engages the small diameter portions 202 of the bushings 182. The springs 180, acting at these underlying portions 200, provide a force vector extending in a generally downward direction which can be resolved into force vectors directed to the printhead surface 152 and toward the axis of rotation of the gears 170. These forces permit the platen roller to move within the slots 35 (FIGS. 2A and 2B). These slots restrict the platen roller's motion, and the platen roller can be displaced only into engagement with the printhead, and with the driven gear 36 into engagement with the gear 170 of the gear train 100. Because of the bend of the portion 200 the spring not only biases the platen 28 and gear 36 against the head 33 and gear 170, but also provides a latch, holding the platen in engagement with the printhead and the driven gear 36 in engagement with the last gear 170 of the gear train 100. This engagement can be broken and the platen 28 and its driven gear 36 separated from the printhead and the last gear 170 easily by retracting the cover as by grasping the sides of the cover at the ridged finger holes 43 thereon. The floating connection of the platen to the cover, preferably by means of the slots 35, also enables the platen roller 28 to align itself and distribute evenly the force exerted by the platen roller against the printhead element 86 via the paper.

From the foregoing description it will be apparent that there has been provided an improved, miniature printer/card reader which is compatible with the target cost objectives for such units. The invention also provides an improved printing mechanism which is especially adapted to be miniaturized and used in portable equipment such as the herein described printer/card reader. Variations and modifications in the herein described apparatus, within the scope of the invention, will undoubtedly suggest themselves to those skilled in the art. Accordingly, the foregoing description should be taken as illustrative and not in a limiting sense.

We claim:

1. Printer apparatus comprising a frame, a printhead mounted in said frame, a platen roller movable over a path between positions along said path out of and into engagement with said printhead, at least one spring member mounted to said frame and separated from said platen roller when in the out-of-engagement-with-printhead position, said spring member having an end projecting across that path, said spring member being configured to define a latch for said platen roller when said platen roller moves into engagement with said printhead, said spring member being disposed in a latching and biasing relationship with said platen roller, when said roller moves along said path into engagement with said printhead.

2. Printer apparatus according to claim 1 wherein said frame has side plates and said printhead is mounted in said frame between said side plates, said at least one spring member being mounted on at least one of said side plates.

3. Printer apparatus according to claim 1 wherein said printhead is fixed in said frame.

4. The printer apparatus according to claim 3 wherein said frame has side plates, said side plates having notches therein, ears extending from said printhead into said notches for fixedly mounting said printhead between said side plates in said frame.

5. The printer apparatus according to claim 4 wherein said printhead is removably placeable in said frame by a latching mechanism provided by said side plates which have flexible portions defining at least one wall of said notches and being yieldable for latching engagement with said ears when said printhead is placed in said frame.

6. The printer apparatus according to claim 1 further comprising a first housing section in which said frame is mounted, and a cover hinged to said first housing section in which said platen roller is rotatably mounted for movement along said path.

7. The printer apparatus according to claim 6 further comprising mounting brackets in said cover for said platen roller, said brackets having slots of sufficient size to permit said platen roller to float and move under the bias of said spring member.

8. The printer apparatus according to claim 6, wherein said first housing section and said cover define a compartment for receiving in loose deposition therein a roll of paper, and end of which is extended over said printhead when said cover is open, said compartment being shaped to conform with said roll and being closed by said cover to capture said roll in said housing.

9. Printer apparatus according to claim 8 further comprising an edge guide plate, said compartment having a plurality of slots laterally spaced from each other for receiving said edge guide plate in guiding relationship with one end of said paper roll.

10. Printer apparatus according to claim 6 further comprising a second cover over said housing section and disposed opposite to the end of said first cover which carries said platen which is hinged to receive said first cover in abutting relationship for closing said housing member with said first cover, said first and second covers defining a slot through which paper from said roll extends.

11. Printer apparatus according to claim 10, wherein said printhead has a tear bar extending laterally across said printhead into engagement with said paper, said second housing section having a feature extending in protective relationship across said tear bar.

12. Printer apparatus according to claim 10, further comprising a magnetic card reader assembly mounted to said housing section adjacent to said end thereof on which said second cover is hinged, and said second cover having a step region and an opening therethrough which exposes said magnetic card reader when said second cover is closed.

13. Printer apparatus according to claim 10 wherein said second cover is hinged to said housing section at the end thereof opposite the end of said section to which said platen carrying cover is hinged.

14. Printer apparatus according to claim 1, wherein said printhead is fixedly mounted in said frame and has print elements disposed in a plane which is canted in a direction towards said platen roller at an angle of about 15° to the vertical.

15. Printer apparatus comprising a frame, a printhead mounted in said frame, a platen roller movable over a path into engagement with said printhead, at least one spring member mounted to said frame and having an end projecting across that path, said spring member being disposed in a latching and biasing relationship with said platen roller, when said roller moves along said path into engagement with said printhead, said at least one spring member is a hairpin spring having a portion inwardly of said end which deflects first in a direction away from said printhead and then toward said printhead, said portion being disposed in biasing relationship with said roller when said spring deflects toward said printhead.

16. Printer apparatus according to claim 15 wherein spring is composed of resilient material.

17. Printer apparatus comprising a frame, a printhead mounted in said frame, a platen roller movable over a path into engagement with said printhead, at least one spring member mounted to said frame and having an end projecting across that path, said spring member being disposed in a latching and biasing relationship with said platen roller, when said roller moves along said path into engagement with said printhead, said frame has side plates and said printhead is mounted in said frame between said side plates, said at least one spring member being mounted on at least one of said side plates, and wherein a pair of said spring members are provided, one on each of said side plates with said end of each of said spring members projecting upwardly from said side plates and being spaced from said printhead.

18. Printer apparatus according to claim 17 wherein said platen roller has a shaft, a drive member on said shaft spaced outwardly from said roller, a driver member rotatably mounted on one of said side frames, said driver member and said platen roller drive member being biased and latched into engagement with each other by said springs, when said platen roller moves into engagement with said printhead.

19. Printer apparatus according to claim 18 wherein said drive member is a driven gear and said driver member is a driver gear.

20. Printer apparatus according to claim 19 further comprising bushings on said shaft adjacent opposite ends of said platen roller, one of said bushings being disposed between one of said opposite ends of said platen roller and said driven gear on said shaft, said springs being spaced apart approximately equal to the spacing of said bushings and engaging said bushings so as to latch and bias said pressure roller against said printhead.

* * * * *